US009868500B1

(12) United States Patent
Mizutani

(10) Patent No.: US 9,868,500 B1
(45) Date of Patent: Jan. 16, 2018

(54) OUTBOARD MOTOR

(71) Applicant: YAMAHA HATSUDOKI KABUSHIKI KAISHA, Iwata-shi, Shizuoka (JP)

(72) Inventor: Makoto Mizutani, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/398,780

(22) Filed: Jan. 5, 2017

(30) Foreign Application Priority Data

Jul. 4, 2016 (JP) ..... 2016-132756

(51) Int. Cl.

| | |
|---|---|
| ***B63H 23/08*** | (2006.01) |
| ***B63H 20/06*** | (2006.01) |
| ***B63H 20/12*** | (2006.01) |
| ***B63H 20/10*** | (2006.01) |
| ***B63H 20/00*** | (2006.01) |
| ***B63H 21/32*** | (2006.01) |
| *B63H 25/02* | (2006.01) |
| *B63H 21/21* | (2006.01) |
| *B63H 23/34* | (2006.01) |

(52) U.S. Cl.
CPC ..... *B63H 20/06* (2013.01); *B63H 20/001* (2013.01); *B63H 20/002* (2013.01); *B63H 20/10* (2013.01); *B63H 20/12* (2013.01); *B63H 21/32* (2013.01); *B63H 21/21* (2013.01); *B63H 23/08* (2013.01); *B63H 23/34* (2013.01); *B63H 2025/022* (2013.01)

(58) Field of Classification Search
CPC ..... B63H 21/305; B63H 20/12
See application file for complete search history.

(56) References Cited

U.S. PATENT DOCUMENTS

| | | | | |
|---|---|---|---|---|
| 1,734,910 | A * | 11/1929 | King | B63B 43/00 440/53 |
| 1,932,785 | A * | 10/1933 | Irgens | B63H 20/06 248/609 |
| 2,739,561 | A | 3/1956 | Kiekhaefer | |
| 3,195,521 | A * | 7/1965 | Larsen | F01P 3/202 123/195 P |
| 2014/0030939 | A1 | 1/2014 | Kanno | |

FOREIGN PATENT DOCUMENTS

| | | | |
|---|---|---|---|
| JP | 10-18841 | A | 1/1998 |
| JP | 2014-24501 | A | 2/2014 |
| WO | 2007/021019 | A1 | 2/2007 |

* cited by examiner

*Primary Examiner* — Edwin Swinehart
(74) *Attorney, Agent, or Firm* — Keating & Bennett, LLP

(57) ABSTRACT

An outboard motor includes an outboard motor body, a mount mounted on a boat body, and a support member that supports the outboard motor body so as to be steerable with respect to the mount. The support member includes an upper support that surrounds a drive shaft and supports the outboard motor body, a lower support that is spaced below the upper support, surrounds the drive shaft, and supports the outboard motor body, and a coupler that couples the upper support to the lower support.

16 Claims, 7 Drawing Sheets

FIRST PREFERRED EMBODIMENT

SECOND PREFERRED EMBODIMENT

OUTBOARD MOTOR

CROSS-REFERENCE TO RELATED APPLICATION

This application claims priority to Patent Application No. 2016-132756 filed in Japan on Jul. 4, 2016, the entire contents of which are herein incorporated by reference.

BACKGROUND OF THE INVENTION

1. Field of the Invention

The present invention relates to an outboard motor.

2. Description of the Related Art

An outboard motor is known in general. Such an outboard motor is disclosed in Japanese Patent Laid-Open No. 2014-024501, for example.

Japanese Patent Laid-Open No. 2014-024501 discloses an outboard motor including an outboard motor body including an engine and a drive shaft that is coupled to the engine and transmits power, and a bracket that is mounted on a boat body and supports the outboard motor body such that the outboard motor body is steerable about a steering shaft. In the outboard motor disclosed in Japanese Patent Laid-Open No. 2014-024501, the steering shaft is arranged at a position spaced forward of the drive shaft.

In the conventional outboard motor disclosed in Japanese Patent Laid-Open No. 2014-024501, the steering shaft is arranged at the position spaced forward of the drive shaft, and hence the entire length of a boat including the outboard motor is increased. Furthermore, the center of gravity of the outboard motor is spaced rearward from the boat body, and hence it is necessary to increase the flotation or buoyancy of the boat body such that a rear portion of the boat body does not sink. Thus, the boat body is increased in size. Therefore, an outboard motor that significantly reduces or prevents an increase in the size of a boat body on which the outboard motor is mounted while significantly reducing or preventing an increase in the entire length of a boat including the outboard motor is desired.

SUMMARY OF THE INVENTION

Preferred embodiments of the present invention provide an outboard motor that significantly reduces or prevents an increase in the size of a boat body on which the outboard motor is mounted while significantly reducing or preventing an increase in the entire length of a boat including the outboard motor.

An outboard motor according to a preferred embodiment of the present invention includes an outboard motor body including an engine and a drive shaft that is coupled to the engine and transmits power, a mount mounted on a boat body, and a support member that supports the outboard motor body so as to be steerable with respect to the mount, and the support member includes an upper support that surrounds the drive shaft and supports the outboard motor body, a lower support that is spaced below the upper support, surrounds the drive shaft, and supports the outboard motor body, and a coupler that couples the upper support to the lower support.

In an outboard motor according to a preferred embodiment of the present invention, the support member that steerably supports the outboard motor body includes the upper support that surrounds the drive shaft and supports the outboard motor body, the lower support that is spaced below the upper support, surrounds the drive shaft, and supports the outboard motor body, and the coupler that couples the upper support to the lower support. Thus, a steering axis and the drive shaft are close to each other, and hence an increase in the entire length of a boat including the outboard motor is significantly reduced or prevented. Furthermore, the steering axis and the drive shaft are close to each other, and hence the center of gravity of the outboard motor is close to the boat body. Thus, it is not necessary to increase the amount of float of the boat body. Consequently, an increase in the size of the boat body is significantly reduced or prevented. In addition, the upper support and the lower support steerably support the outboard motor body, and hence friction (frictional resistance) generated during steering is reduced as compared with the case where the outboard motor is supported by an entire steering shaft. Moreover, the upper support and the lower support are coupled to each other by the coupler, and hence relative displacement of positions of support of the upper support and the lower support is significantly reduced or prevented.

In an outboard motor according to a preferred embodiment of the present invention, the outboard motor body preferably includes a cover that covers the drive shaft, and the coupler preferably couples the upper support to the lower support at a position outside of the cover. Accordingly, at a position spaced from the steering axis and outside of the cover, the upper support and the lower support are coupled to each other by the coupler, and hence relative displacement of the positions of support of the upper support and the lower support is significantly reduced or prevented as compared with the case where the upper support and the lower support are coupled to each other near the steering axis.

In an outboard motor according to a preferred embodiment of the present invention, the coupler preferably includes a pair of couplers. Accordingly, relative displacement of the positions of support of the upper support and the lower support is effectively significantly reduced or prevented by the pair of couplers.

In an outboard motor according to a preferred embodiment of the present invention, the support member preferably supports the outboard motor body at a position forward of an exhaust passage through which exhaust air from the engine flows. Accordingly, the exhaust passage that is a space is located in a rear portion of the outboard motor body, and hence the center of gravity of the outboard motor body is located forward. Consequently, the center of gravity of the outboard motor is close to the boat body.

In an outboard motor according to a preferred embodiment of the present invention, the outboard motor body preferably includes a cover that covers the drive shaft and a housing provided with a through-hole in which the drive shaft is located, and the support member preferably surrounds the through-hole and supports the housing. Accordingly, the support member supports the housing including the through-hole, and hence the support member surrounds the drive shaft and easily supports the outboard motor body.

In this case, a shift shaft that changes a shift state is preferably located in the through-hole of the housing. Accordingly, the shift shaft is easily positioned using the through-hole through which the drive shaft passes.

In the structure in which the outboard motor body includes the housing, the housing is preferably provided with a flow passage through which at least one of exhaust air from the engine, engine oil, and cooling water flows.

Accordingly, the flow passage is integrally provided in the housing supported by the support member, and hence an increase in the number of components is significantly reduced or prevented.

In an outboard motor according to a preferred embodiment of the present invention, the outboard motor body preferably includes a cover that covers the drive shaft, and the support member preferably includes a support that supports the outboard motor body, and supports the outboard motor body by the support inside the cover. Accordingly, as compared with the case where the outboard motor body is supported by a support outside the cover, the steering axis and the drive shaft are closer to each other, and hence an increase in the size of the boat body on which the outboard motor is mounted is further significantly reduced or prevented while an increase in the entire length of the boat including the outboard motor is further significantly reduced or prevented.

In this case, the cover preferably includes a first cover and a second cover below the first cover, the upper support preferably includes an upper support that supports the outboard motor body, and supports the outboard motor body by the upper support inside the first cover, and the lower support preferably includes a lower support that supports the outboard motor body, and supports the outboard motor body by the lower support inside the second cover. Accordingly, the outboard motor body is supported by the upper support inside the first cover while the outboard motor body is supported by the lower support inside the second cover, and hence the outboard motor body is supported in a balanced manner at positions vertically spaced apart while the steering axis and the drive shaft are close to each other.

In an outboard motor according to a preferred embodiment of the present invention, the support member preferably supports the outboard motor body through a damper. Accordingly, transfer of vibrations of the outboard motor body to the boat body is significantly reduced or prevented.

In this case, the damper is preferably annular, and preferably has an inner diameter larger than the drive shaft and an outer diameter smaller than or equal to an inner diameter of a support hole that supports the outboard motor body. Accordingly, transfer of vibrations of the outboard motor body to the boat body is effectively significantly reduced or prevented by the damper having the inner diameter larger than the drive shaft and the outer diameter smaller than or equal to the inner diameter of the support hole.

In the structure in which the support member supports the outboard motor body through the damper, the outboard motor body preferably includes a housing including a boss that protrudes in an axial direction of the drive shaft, and the support member preferably supports the outboard motor body by fitting or inserting the boss into the support hole through the damper. Accordingly, the support member supports the outboard motor body by inserting the boss provided on the housing of the outboard motor body into the support hole, and hence the outboard motor body is easily rotated about the steering axis.

In this case, the support member preferably supports the outboard motor body by inserting the boss into the support hole through a collar that is annular and facilitates rotation of the outboard motor body and the damper. Accordingly, rotation of the outboard motor body is facilitated by the collar while transfer of vibrations of the outboard motor body is significantly reduced or prevented by the damper, and hence the outboard motor body is more easily rotated about the steering axis.

In an outboard motor according to a preferred embodiment of the present invention, the support member preferably rotatably supports the outboard motor body about a steering axis, and the steering axis preferably overlaps with the drive shaft as viewed in an axial direction of the drive shaft. Accordingly, the steering axis and the drive shaft are reliably close to each other, and hence an increase in the size of the boat body on which the outboard motor is mounted is more effectively significantly reduced or prevented while an increase in the entire length of the boat including the outboard motor is more effectively significantly reduced or prevented.

An outboard motor according to a preferred embodiment of the present invention preferably further includes a trim-tilt mechanism that couples the lower support of the support member to the mount and rotates the outboard motor body in a vertical direction. Accordingly, a coupling position of the trim-tilt mechanism with respect to the boat body is elevated, and hence the drive amount of the trim-tilt mechanism is reduced when the outboard motor is fully tilted up. Furthermore, when the outboard motor is fully tilted up, the coupling position where the trim-tilt mechanism is attached to the boat body is prevented from being under water.

An outboard motor according to a preferred embodiment of the present invention preferably further includes a trim-tilt mechanism that couples the coupler of the support member to the mount and rotates the outboard motor body in a vertical direction. Accordingly, the coupling position of the trim-tilt mechanism with respect to the boat body is elevated, and hence the drive amount of the trim-tilt mechanism is reduced when the outboard motor is fully tilted up. Furthermore, when the outboard motor is fully tilted up, the coupling position where the trim-tilt mechanism is attached to the boat body is prevented from being under water.

In this case, a coupling position of the trim-tilt mechanism with respect to the coupler of the support member is preferably adjustable. Accordingly, the coupling position of the trim-tilt mechanism is adjusted according to the size of the boat body and the size of the outboard motor such that the trim of the outboard motor is properly adjusted, and the outboard motor is properly tilted up.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

First Preferred Embodiment

The structure of a boat 10 including an outboard motor 100 according to a first preferred embodiment of the present invention is now described with reference to FIG. 1. In the figures, arrow FWD represents the forward movement direction of the boat 10, and arrow BWD represents the reverse movement direction of the boat 10. In the figures, arrow R represents the starboard direction of the boat 10, and arrow L represents the portside direction of the boat 10.

Figure 1:
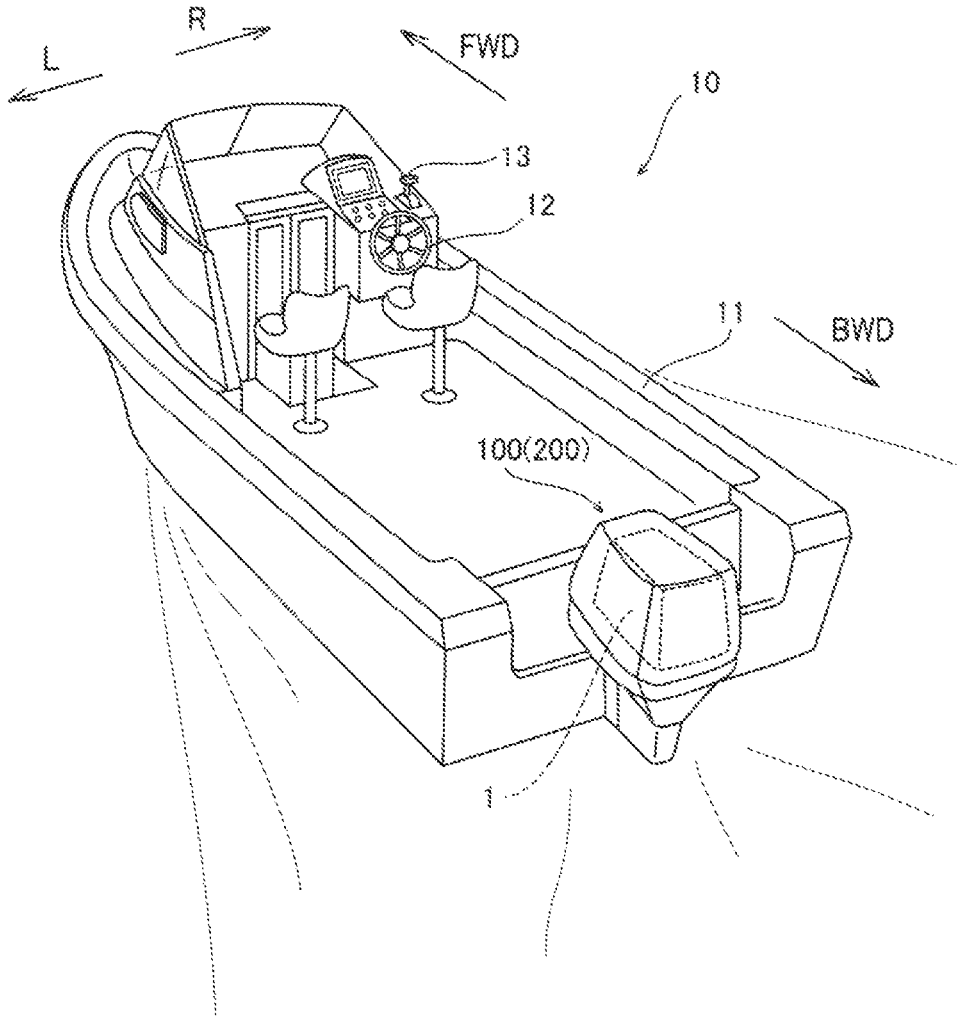
FIG. 1 is a diagram schematically showing a boat including an outboard motor according to first and second preferred embodiments of the present invention.

The boat 10 includes a boat body 11, a steering wheel 12, and remote controller 13, as shown in FIG. 1. The outboard motor 100 is mounted on the boat 10.

The steering wheel 12 steers the boat body 11 (turns the outboard motor 100). Specifically, the steering wheel 12 is connected to a steering device of the outboard motor 100. The steering device rotates the outboard motor 100 in a horizontal direction based on operation of the steering wheel 12.

The remote controller 13 manipulates the shift and output (throttle position) of the outboard motor 100. Specifically, the remote controller 13 is connected to the outboard motor 100. The output and the shift (forward movement, reverse movement, or neutral) of an engine 1 of the outboard motor 100 are controlled based on operation of the remote controller 13.

Figure 2:
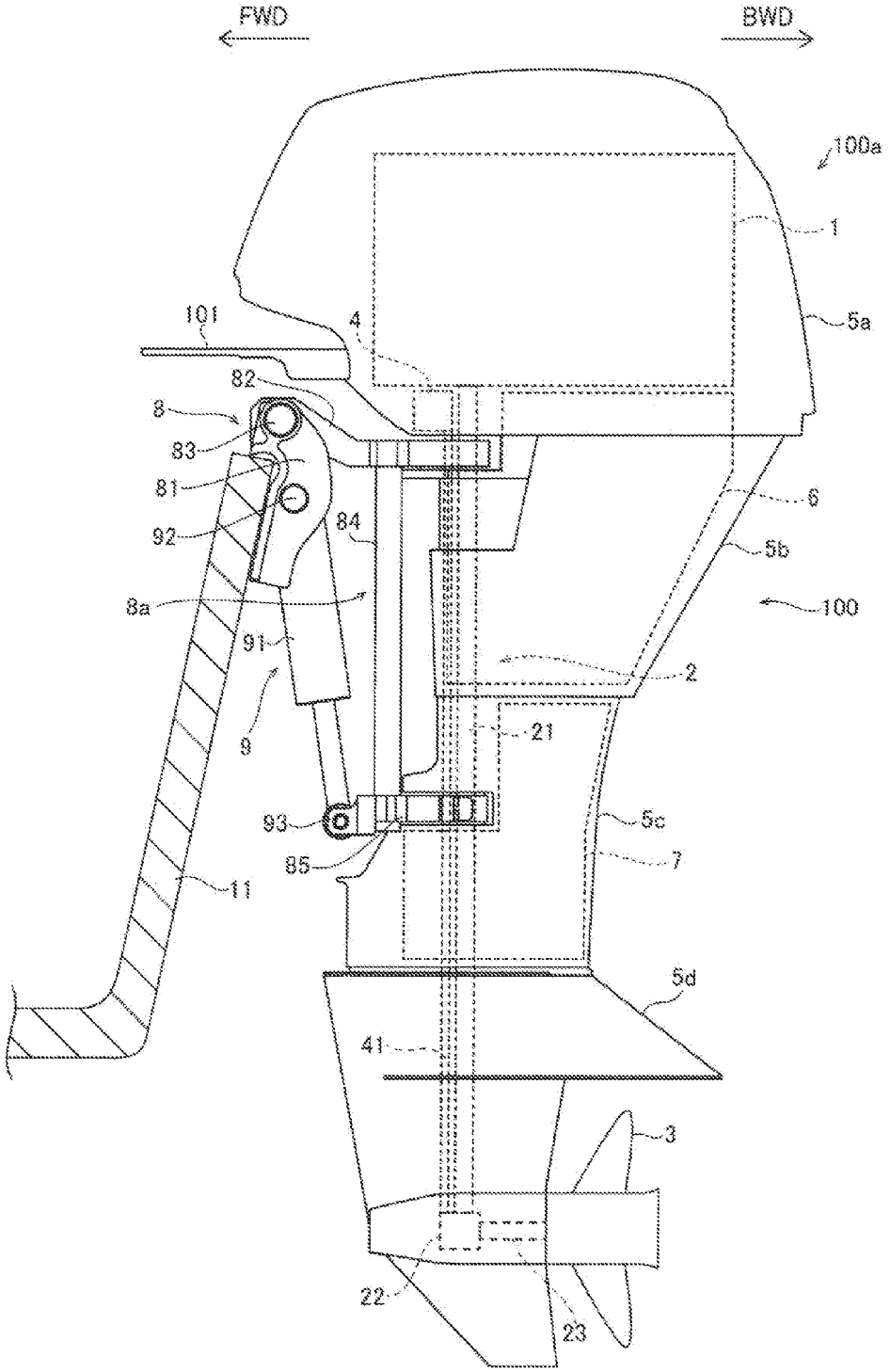
FIG. 2 is a side elevational view schematically showing the outboard motor according to the first preferred embodiment of the present invention.

The outboard motor 100 is mounted on a rear portion of the boat body 11, as shown in FIG. 1. The outboard motor 100 includes an outboard motor body 100*a*, as shown in FIG. 2. The outboard motor body 100*a* includes the engine 1, a power transmission 2, a propeller 3, a shift actuator 4, an engine cover 5*a*, an apron 5*b*, an upper cover 5*c*, a lower cover 5*d*, an upper housing 6, and a lower housing 7. The outboard motor 100 includes an outboard motor mount 8 and a trim-tilt mechanism 9. The outboard motor body 100*a* is mounted on the boat body 11 to be rotatable about a vertical axis and a horizontal axis by the outboard motor mount 8. The apron 5*b* is an example of a "cover" or a "first cover," and the upper cover 5*c* is an example of a "cover" or a "second cover."

Figure 3:
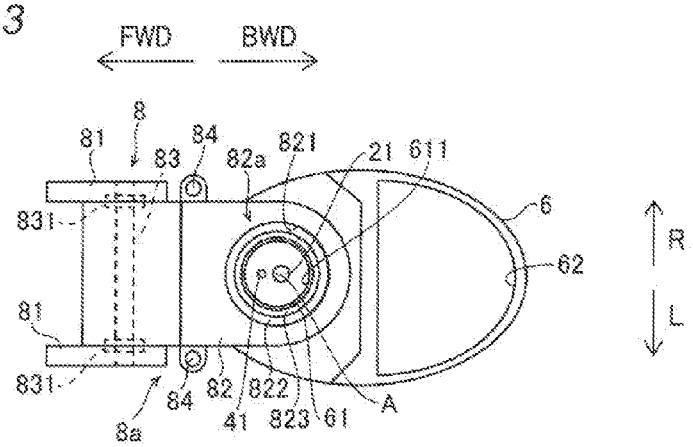
FIG. 3 is a plan view showing an upper support of the outboard motor according to the first preferred embodiment of the present invention.
Figure 5:
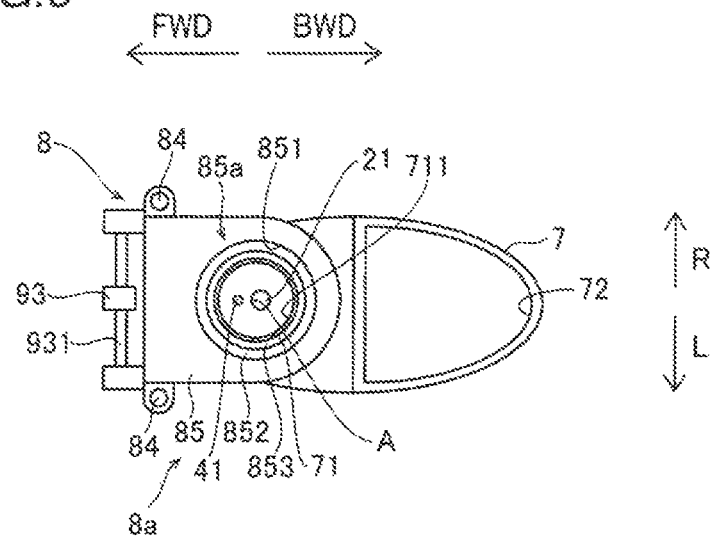
FIG. 5 is a plan view showing the lower support of the outboard motor according to the first preferred embodiment of the present invention.

The power transmission 2 includes a drive shaft 21, a gearing 22, and a propeller shaft 23. The shift actuator 4 is connected to the gearing 22 through a shift shaft 41. The upper housing 6 includes a boss 61 and a flow passage 62, as shown in FIG. 3. The lower housing 7 includes a boss 71 and a flow passage 72, as shown in FIG. 5. The flow passages 62 and 72 are examples of an "exhaust passage."

The outboard motor mount 8 includes a pair of clamp brackets 81, an upper support 82, a trim-tilt shaft 83, a pair of couplers 84, and a lower support 85, as shown in FIG. 2. The outboard motor mount 8 includes a support member 8*a* including the upper support 82, the couplers 84, and the lower support 85. The trim-tilt mechanism 9 includes a cylinder 91, an upper mount 92, and a lower mount 93. The clamp brackets 81 are examples of a "mount."

The engine 1 is located in an upper portion of the outboard motor 100, and includes an internal combustion driven by explosive combustion of gasoline, light oil, or the like. The engine 1 is covered by the engine cover 5*a*.

The drive shaft 21 is coupled to a crankshaft of the engine 1 so as to transmit the power of the engine 1. The drive shaft 21 extends in a vertical direction. The drive shaft 21 is rotatably coupled to the engine 1. The drive shaft 21 is covered by the apron 5*b*, the upper cover 5*c*, and the lower cover 5*d*. In other words, an upper portion of the drive shaft 21 is covered by the apron 5*b*, an intermediate portion of the drive shaft 21 is covered by the upper cover 5*c*, and a lower portion of the drive shaft 21 is covered by the lower cover 5*d*.

The gearing 22 is located in a lower portion of the outboard motor 100. The gearing 22 decreases the rotational speed of the drive shaft 21 and transmits the decreased rotational speed to the propeller shaft 23. In other words, the gearing 22 transmits the drive force of the drive shaft 21 that rotates about a rotation axis extending in the vertical direction to the propeller shaft 23 that rotates about a rotation axis extending in a front to back direction. Specifically, the gearing 22 includes a pinion gear, a forward movement bevel gear, a reverse movement bevel gear, and a dog clutch. The pinion gear is mounted on a lower end of the drive shaft 21. The forward movement bevel gear and the reverse movement bevel gear are provided on the propeller shaft 23 to hold the pinion gear therebetween. The pinion gear meshes with the forward movement bevel gear and the reverse movement bevel gear. The gearing 22 switches between a state where the dog clutch that rotates integrally with the propeller shaft 23 engages with the forward movement bevel gear and a state where the dog clutch engages with the reverse movement bevel gear so as to switch the shift position (the rotation direction (the forward movement direction and the reverse movement direction) of the propeller shaft 23). The gearing 22 switches to a state where the dog clutch engages with neither the forward movement bevel gear nor the reverse movement bevel gear so as to change the shift position to neutral. The gearing 22 and the propeller shaft 23 are covered by the lower cover 5*d*.

The propeller 3 is connected to the propeller shaft 23. The propeller 3 is driven to rotate about the rotation axis extending in the front to back direction. The propeller 3 rotates in water to generate thrust force in an axial direction. The propeller 3 moves the boat body 11 forward or reversely according to the rotation direction.

The shift actuator 4 switches the shift state of the outboard motor 100 based on the user's operation. Specifically, the shift actuator 4 changes the shift position to any of forward movement, reverse movement, and neutral. More specifically, the shift actuator 4 changes the meshing of the gearing 22 through the shift shaft 41 to switch the shift state.

On a front portion of the engine cover 5*a*, a bar 101 is mounted. The bar 101 steers the outboard motor body 100*a*. In other words, the bar 101 is moved right and left by the steering device such that the outboard motor body 100*a* is rotated about a steering axis A (see FIGS. 3 and 5).

The apron 5*b* is located below the engine cover 5*a*. In other words, the apron 5*b* is located below the engine 1. The upper cover 5*c* is located below the apron 5*b*. The lower cover 5*d* is located below the upper cover 5*c*.

The upper housing 6 is located below the engine 1 and supports the engine 1, as shown in FIG. 2. The upper housing 6 is covered by the engine cover 5*a* and the apron 5*b*. The upper housing 6 is supported by the upper support 82. Specifically, the upper housing 6 is supported by the upper support 82 so as to be rotatable about the steering axis A, as shown in FIG. 3. The boss 61 of the upper housing 6 protrudes in the axial direction of the drive shaft 21. The boss 61 is located in a front portion of the upper housing 6. The boss 61 is annular. A through-hole 611 is provided inside the boss 61. The drive shaft 21 is located in the through-hole 611. The shift shaft 41 is located in the through-hole 611. The shift shaft 41 is forward of the drive shaft 21. The flow passage 62 is located in a rear portion of the upper housing 6. At least one of exhaust air from the engine 1, engine oil, and cooling water flows through the flow passage 62. The flow passage 62 may be provided with an oil pan in which the engine oil is accumulated.

The lower housing 7 is located below the upper housing 6, as shown in FIG. 2. The lower housing 7 is covered by the upper cover 5*c*. The lower housing 7 is supported by the lower support 85. Specifically, the lower housing 7 is supported by the lower support 85 so as to be rotatable about the steering axis A, as shown in FIG. 5. The boss 71 of the lower housing 7 protrudes in the axial direction of the drive shaft 21. The boss 71 is located in a front portion of the lower housing 7. The boss 71 is annular. A through-hole 711 is provided inside the boss 71. The drive shaft 21 is located in the through-hole 711. The shift shaft 41 is located in the through-hole 711. The shift shaft 41 is located forward of the drive shaft 21. The flow passage 72 is located in a rear portion of the lower housing 7. At least one of exhaust air from the engine 1, engine oil, and cooling water flows through the flow passage 72. The flow passage 72 may be provided with an oil pan in which the engine oil accumulates.

The outboard motor mount 8 is mounted on the boat body 11 so as to support the outboard motor body 100*a*. Specifically, the pair of clamp brackets 81 is fixed to the rear portion of the boat body 11. The outboard motor body 100*a* is supported by the support member 8*a* so as to be steerable with respect to the clamp brackets 81. More specifically, the support member 8*a* is supported by the clamp brackets 81 so as to be rotatable about the trim-tilt shaft 83. The upper support 82 of the support member 8*a* is rotatably coupled to the clamp brackets 81 through the trim-tilt shaft 83. The upper support 82 is coupled to the lower support 85 through the couplers 84. The outboard motor body 100*a* is supported by the upper support 82 and the lower support 85 so as to be steerable about the steering axis A and rotatable about the trim-tilt shaft 83.

According to the first preferred embodiment of the present invention, the support member 8*a* surrounds the drive shaft 21 and supports the outboard motor body 100*a*, as shown in FIGS. 3 and 5. In other words, the upper support 82 surrounds the drive shaft 21 and supports the outboard motor body 100*a*. The lower support 85 spaced below the upper support 82 surrounds the drive shaft 21 and supports the outboard motor body 100*a*. Thus, the support member 8*a* supports the outboard motor body 100*a* such that the outboard motor body 100*a* is rotatable about the steering axis A. The steering axis A overlaps with the drive shaft 21 as viewed in the axial direction of the drive shaft 21. According to the first preferred embodiment of the present invention, the steering axis A coincides with a portion of the drive shaft 21 forward of the center of the drive shaft 21. The support member 8*a* supports the outboard motor body 100*a* at a position forward of the flow passages 62 and 72 through which exhaust air from the engine 1 flows.

According to the first preferred embodiment of the present invention, the upper support 82 includes an upper support 82*a*, as shown in FIG. 3. The upper support 82*a* supports the outboard motor body 100*a*. Specifically, the upper support 82*a* includes a circular support hole 821. The upper support 82 supports the upper housing 6 (outboard motor body 100*a*) by inserting the boss 61 of the upper housing 6 into the support hole 821. The upper support 82 supports the outboard motor body 100*a* by the upper support 82*a* inside the apron 5*b*.

Figure 4:
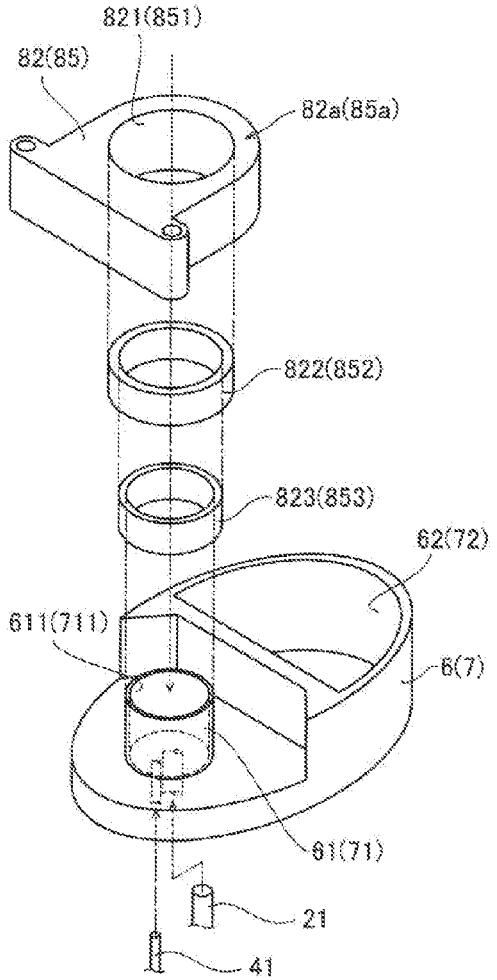
FIG. 4 is an exploded perspective view schematically showing the upper support or a lower support of the outboard motor according to the first preferred embodiment of the present invention.

The upper support 82 surrounds the through-hole 611 of the boss 61 and supports the upper housing 6. The upper support 82 supports the outboard motor body 100*a* through an annular damper 822. Specifically, the upper support 82 supports the outboard motor body 100*a* by inserting the boss 61 into the support hole 821 of the upper support 82*a* through an annular collar 823 and the annular damper 822, as shown in FIG. 4. As shown in FIG. 3, the inner diameters of the annular damper 822 and the annular collar 823 are larger than the outer diameter of the drive shaft 21. The outer diameters of the annular damper 822 and the annular collar 823 are smaller than the inner width of the apron 5*b*. The outer diameters of the annular damper 822 and the annular collar 823 are smaller than or equal to the inner diameter of the support hole 821. The damper 822 is located outside the collar 823. The boss 61 is located inside the collar 823. The collar 823 facilitates rotation of the outboard motor body 100*a*. In other words, the collar 823 and the boss 61 easily slide over each other, and hence the upper housing 6 (outboard motor body 100*a*) easily rotates with respect to the upper support 82 (support member 8*a*). In FIGS. 3 and 4, the upper support 82 and the upper housing 6 are shown in a simplified manner in order to make it easy to understand the structure.

Figure 6:
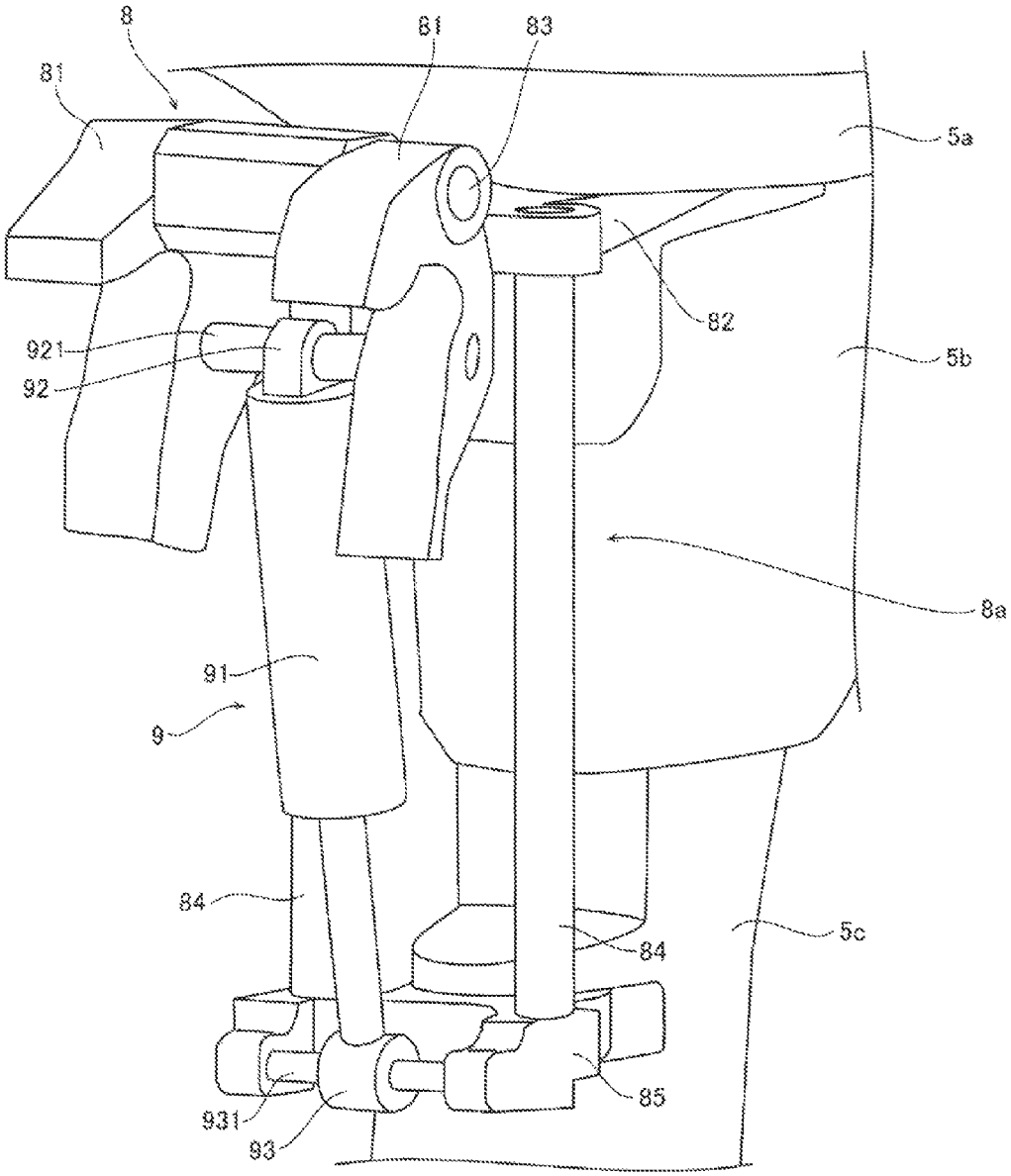
FIG. 6 is a perspective view showing a support member of the outboard motor according to the first preferred embodiment of the present invention.

The trim-tilt shaft 83 supports the support member 8*a* such that the support member 8*a* is rotatable in the vertical direction. The trim-tilt shaft 83 is supported by the pair of clamp brackets 81, as shown in FIG. 6. Specifically, the trim-tilt shaft 83 is held between the pair of clamp brackets 81 through a pair of dampers 831 and is supported by the pair of clamp brackets 81, as shown in FIG. 3.

The couplers 84 couple the upper support 82 to the lower support 85, as shown in FIG. 6. The pair of couplers 84 are spaced apart at a predetermined interval in a right to left direction. The couplers 84 couple the upper support 82 to the lower support 85 at locations spaced outward from the apron 5*b* and the upper cover 5*c*. Specifically, the couplers 84 couple the upper support 82 to the lower support 85 at locations spaced forward of the apron 5*b* and the upper cover 5*c*. The couplers 84 are preferably made of a material containing carbon fiber, for example.

According to the first preferred embodiment of the present invention, the lower support 85 includes a lower support 85*a*, as shown in FIG. 5. The lower support 85*a* supports the outboard motor body 100*a*. Specifically, the lower support 85*a* includes a circular support hole 851. The lower support 85 supports the lower housing 7 (outboard motor body 100*a*) by inserting the boss 71 of the lower housing 7 into the support hole 851. The lower support 85 supports the outboard motor body 100*a* by the lower support 85*a* inside the upper cover 5*c*.

The lower support 85 surrounds the through-hole 711 of the boss 71 and supports the lower housing 7. The lower support 85 supports the outboard motor body 100*a* through an annular damper 852. Specifically, the lower support 85 supports the outboard motor body 100*a* by inserting the boss 71 into the support hole 851 of the lower support 85*a* through an annular collar 853 and the annular damper 852, as shown in FIG. 4. As shown in FIG. 5, the inner diameters of the annular damper 852 and the annular collar 853 are larger than the outer diameter of the drive shaft 21. The outer diameters of the annular damper 852 and the annular collar 853 are smaller than the inner width of the upper cover 5*c*. The outer diameters of the annular damper 852 and the annular collar 853 are smaller than or equal to the inner diameter of the support hole 851. The damper 852 is located outside the collar 853. The boss 71 is located inside the collar 853. The collar 853 facilitates rotation of the outboard motor body 100*a*. In other words, the collar 853 and the boss 71 easily slide over each other, and hence the lower housing 7 (outboard motor body 100*a*) easily rotates with respect to the lower support 85 (support member 8*a*). In FIGS. 4 and 5, the lower support 85 and the lower housing 7 are shown in a simplified manner in order to make it easy to understand the structure.

The trim-tilt mechanism 9 changes the angle of the outboard motor body 100*a* with respect to the boat body 11, as shown in FIG. 2. Specifically, the trim-tilt mechanism 9 rotates the outboard motor body 100*a* about the trim-tilt shaft 83. The upper mount 92 of the trim-tilt mechanism 9 is coupled to the clamp brackets 81. Specifically, the upper mount 92 is connected to a connector 921 held between the pair of clamp brackets 81 and coupled to the pair of clamp brackets 81, as shown in FIG. 6. The upper mount 92 is rotatably connected to the connector 921. The lower mount 93 of the trim-tilt mechanism 9 is coupled to the lower support 85. Specifically, the lower mount 93 is connected to a connector 931 coupled to the lower support 85. The lower mount 93 is rotatably connected to the connector 931.

The trim-tilt mechanism 9 adjusts the angle of the outboard motor body 100*a* by extension and retraction of the cylinder 91. Specifically, the cylinder 91 retracts such that the outboard motor body 100*a* is rotated clockwise when the outboard motor body 100*a* is viewed from the left. The cylinder 91 extends such that the outboard motor body 100*a* is rotated counterclockwise when the outboard motor body 100*a* is viewed from the left. The cylinder 91 is hydraulically driven, for example.

According to the first preferred embodiment of the present invention, the following advantageous effects are obtained.

According to the first preferred embodiment of the present invention, the support member 8*a* that steerably supports the outboard motor body 100*a* includes the upper support 82 that surrounds the drive shaft 21 and supports the outboard motor body 100*a*, the lower support 85 that is spaced below the upper support 82, surrounds the drive shaft 21, and supports the outboard motor body 100*a*, and the couplers 84 that couple the upper support 82 to the lower support 85. Thus, the steering axis A and the drive shaft 21 are close to each other, and hence an increase in the entire length of the boat 10 including the outboard motor 100 is significantly reduced or prevented. Furthermore, the steering axis A and the drive shaft 21 are close to each other, and hence the center of gravity of the outboard motor 100 is close to the boat body 11. Thus, it is not necessary to increase the flotation of the boat body 11. Consequently, an increase in the size of the boat body 11 is significantly reduced or prevented. In addition, the upper support 82 and the lower support 85 steerably support the outboard motor body 100*a*, and hence friction (frictional resistance) generated during steering is reduced as compared with the case where the outboard motor is supported by an entire steering shaft. Moreover, the upper support 82 and the lower support 85 are coupled to each other by the couplers 84, and hence relative displacement of the support positions of the upper support 82 and the lower support 85 is significantly reduced or prevented.

According to the first preferred embodiment of the present invention, the couplers 84 couple the upper support 82 to the lower support 85 at locations spaced outward from the apron 5*b* and the upper cover 5*c*. Thus, at the locations spaced from the steering axis A outward from the apron 5*b* and the upper cover 5*c*, the upper support 82 and the lower support 85 are coupled to each other by the couplers 84, and hence relative displacement of the support positions of the upper support 82 and the lower support 85 is significantly reduced or prevented as compared with the case where the upper support 82 and the lower support 85 are coupled to each other near the steering axis A.

According to the first preferred embodiment of the present invention, the pair of couplers 84 is provided. Thus, relative displacement of the support positions of the upper support 82 and the lower support 85 is effectively significantly reduced or prevented by the pair of couplers 84.

According to the first preferred embodiment of the present invention, the support member 8*a* supports the outboard motor body 100*a* at the position forward of the flow passages 62 and 72 through which exhaust air from the engine 1 flows. Thus, spaces for the flow passages 62 and 72 are located in a rear portion of the outboard motor body 100*a*, and hence the center of gravity of the outboard motor body 100*a* is located farther forward. Consequently, the center of gravity of the outboard motor 100 is close to the boat body 11.

According to the first preferred embodiment of the present invention, the outboard motor body 100*a* includes the apron 5*b* and the upper cover 5*c* that cover the drive shaft 21, and the housing 6 (7) inside the apron 5*b* and the upper cover 5*c* that are provided with the through-hole 611 (711) accommodating the drive shaft 21, and the support member 8*a* surrounds the through-hole 611 (711) and supports the housing 6 (7). Thus, the support member 8*a* supports the housing 6 (7) including the through-hole 611 (711), and hence the support member 8*a* surrounds the drive shaft 21 and easily supports the outboard motor body 100*a*.

According to the first preferred embodiment of the present invention, the shift shaft 41 that changes the shift state (changes the meshing of the gearing 22) is located in the through-hole 611 (711) of the housing 6 (7). Thus, the shift shaft 41 is easily positioned using the through-hole 611 (711) through which the drive shaft 21 passes.

According to the first preferred embodiment of the present invention, the flow passage 62 (72) through which at least one of exhaust air from the engine 1, engine oil, and cooling water flows is provided in the housing 6 (7). Thus, the flow passage 62 (72) is integrally provided in the housing 6 (7) supported by the support member 8*a*, and hence an increase in the number of components is significantly reduced or prevented.

According to the first preferred embodiment of the present invention, the support member 8*a* supports the outboard motor body 100*a* by the upper support 82*a* and the lower support 85*a* inside the apron 5*b* and the upper cover 5*c*. Thus, as compared with the case where the outboard motor body 100*a* is supported by support structures outside the apron 5*b* and the upper cover 5*c*, the steering axis A and the drive shaft 21 are closer to each other, and hence an increase in the size of the boat body 11 on which the outboard motor 100 is mounted is further significantly reduced or prevented while an increase in the entire length of the boat 10 including the outboard motor 100 is further significantly reduced or prevented.

According to the first preferred embodiment of the present invention, the upper support 82 supports the outboard motor body 100*a* by the upper support 82*a* inside the apron 5*b*, and the lower support 85 supports the outboard motor body 100*a* by the lower support 85*a* inside the upper cover 5*c*. Thus, the outboard motor body 100*a* is supported by the upper support 82*a* inside the apron 5*b* while the outboard motor body 100*a* is supported by the lower support 85*a* inside the upper cover 5*c*, and hence the outboard motor body 100*a* is supported in a balanced manner at positions vertically spaced apart while the steering axis A and the drive shaft 21 are close to each other.

According to the first preferred embodiment of the present invention, the support member 8*a* supports the outboard motor body 100*a* through the damper 822 (852). Thus, the transfer of vibrations of the outboard motor body 100*a* to the boat body 11 is significantly reduced or prevented.

According to the first preferred embodiment of the present invention, the damper 822 (852) is annular, and has an inner diameter larger than the drive shaft 21 and an outer diameter smaller than or equal to the inner diameter of the support hole 821 (851) as the upper support 82*a* (lower support 85*a*) that supports the outboard motor body 100*a*. Thus, the transfer of vibrations of the outboard motor body 100*a* to the boat body 11 is effectively significantly reduced or prevented by the damper 822 (852) with the inner diameter larger than the drive shaft 21 and the outer diameter smaller than or equal to the inner diameter of the support hole 821 (851).

According to the first preferred embodiment of the present invention, the support member 8*a* supports the outboard motor body 100*a* by inserting the boss 61 (71) of the housing 6 (7) into the support hole 821 (851) through the damper 822 (852). Thus, the support member 8*a* supports the outboard motor body 100*a* by inserting the boss 61 (71) provided on the housing 6 (7) of the outboard motor body 100*a* into the support hole 821 (851), and hence the outboard motor body 100*a* is easily rotated about the steering axis A.

According to the first preferred embodiment of the present invention, the support member 8*a* supports the outboard motor body 100*a* by inserting the boss 61 (71) into the support hole 821 (851) through the collar 823 (853) that is annular and facilitates rotation of the outboard motor body 100*a* and the damper 822 (852). Thus, rotation of the outboard motor body 100*a* is facilitated by the collar 823 (853) while the transfer of vibrations of the outboard motor body 100*a* is significantly reduced or prevented by the damper 822 (852), and hence the outboard motor body 100*a* is more easily rotated about the steering axis A.

According to the first preferred embodiment of the present invention, the steering axis A overlaps with the drive shaft 21 as viewed in the axial direction of the drive shaft 21. Thus, the steering axis A and the drive shaft 21 are reliably close to each other, and hence an increase in the size of the boat body 11 on which the outboard motor 100 is mounted is more effectively significantly reduced or prevented while an increase in the entire length of the boat 10 including the outboard motor 100 is more effectively significantly reduced or prevented.

According to the first preferred embodiment of the present invention, the outboard motor 100 includes the trim-tilt mechanism 9 that couples the lower support 85*a* of the support member 8*a* to the clamp brackets 81 and rotates the outboard motor body 100*a* in the vertical direction. Thus, the coupling position of the trim-tilt mechanism 9 with respect to the boat body 11 is elevated, and hence the drive amount of the trim-tilt mechanism 9 (the amount of extension of the cylinder 91) is reduced when the outboard motor 100 is fully tilted up. Furthermore, when the outboard motor 100 is fully tilted up, the coupling position where the trim-tilt mechanism 9 is attached to the boat body 11 is prevented from being under water.

Second Preferred Embodiment

A second preferred embodiment of the present invention is now described with reference to FIG. 7. In the second preferred embodiment, a trim-tilt mechanism 9*a* is coupled to couplers 84 and a pair of clamp brackets 81, unlike the first preferred embodiment in which the trim-tilt mechanism 9 is coupled to the lower support 85*a* of the support member 8*a* and the clamp brackets 81.

An outboard motor 200 according to the second preferred embodiment of the present invention is mounted on a rear portion of a boat body 11, as shown in FIG. 1. The outboard motor 200 includes an outboard motor body 100*a*, as shown in FIG. 7. The outboard motor body 100*a* includes an engine 1, a power transmission 2, a propeller 3, a shift actuator 4, an engine cover 5*a*, an apron 5*b*, an upper cover 5*c*, a lower cover 5*d*, an upper housing 6, and a lower housing 7. The outboard motor 200 includes an outboard motor mount 8 and the trim-tilt mechanism 9*a*. The outboard motor body 100*a* is mounted on the boat body 11 to be rotatable about a vertical axis and a horizontal axis by the outboard motor mount 8. The apron 5*b* is an example of a "cover" or a "first cover," and the upper cover 5*c* is an example of a "cover" or a "second cover."

Figure 7:
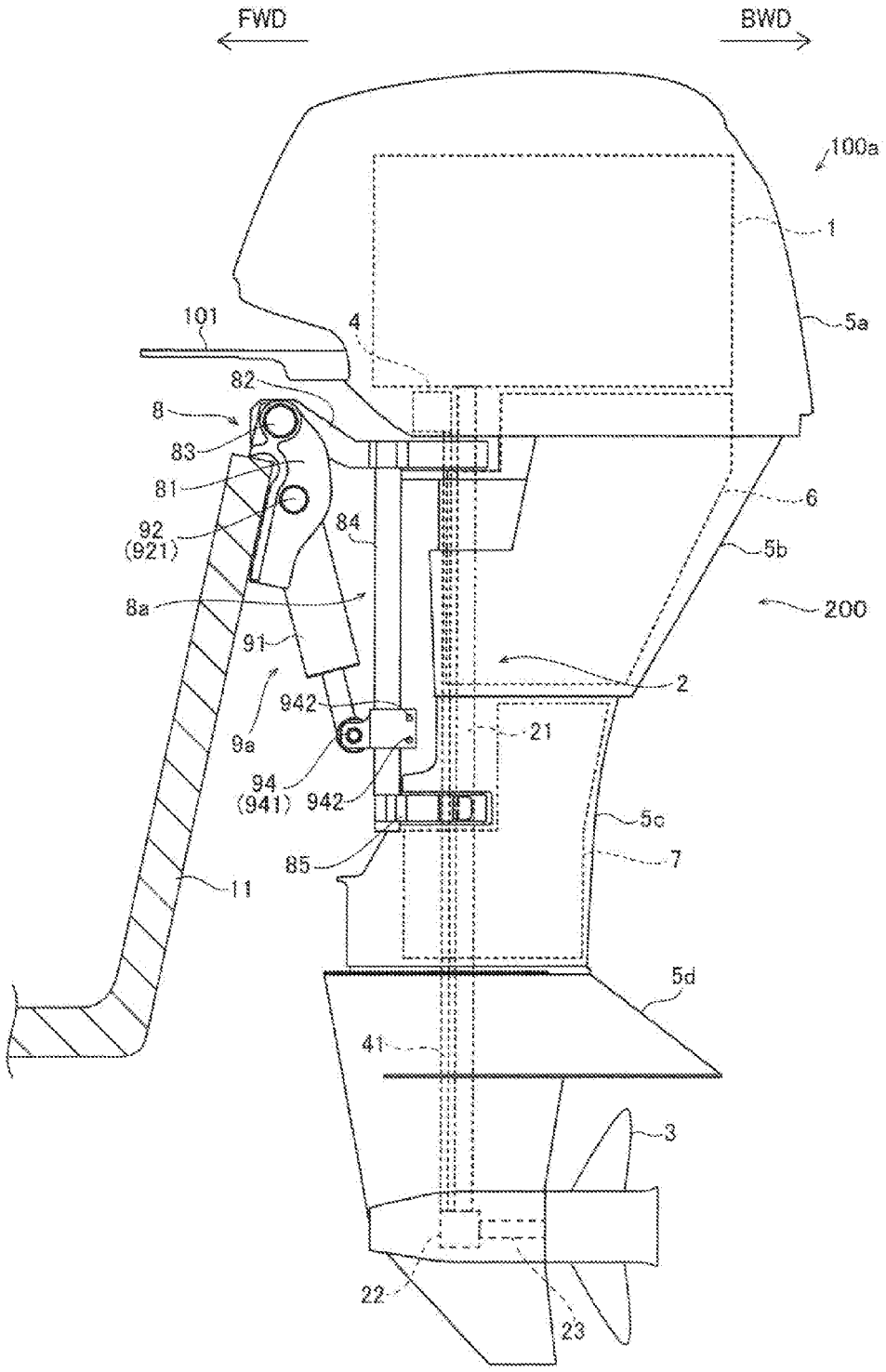
FIG. 7 is a side elevational view schematically showing an outboard motor according to a second preferred embodiment of the present invention.

According to the second preferred embodiment of the present invention, a support member 8*a* surrounds a drive shaft 21 and supports the outboard motor body 100*a*, as shown in FIG. 7. In other words, an upper support 82 surrounds the drive shaft 21 and supports the outboard motor body 100*a*. A lower support 85 spaced below the upper support 82 surrounds the drive shaft 21 and supports the outboard motor body 100*a*. Thus, the support member 8*a* supports the outboard motor body 100*a* such that the outboard motor body 100*a* is rotatable about a steering axis A.

According to the second preferred embodiment of the present invention, the trim-tilt mechanism 9*a* changes the angle of the outboard motor body 100*a* with respect to the boat body 11. Specifically, the trim-tilt mechanism 9*a* rotates the outboard motor body 100*a* about a trim-tilt shaft 83. An upper mount 92 of the trim-tilt mechanism 9*a* is coupled to the clamp brackets 81. Specifically, the upper mount 92 is connected to a connector 921 held between the pair of clamp brackets 81 and coupled to the pair of clamp brackets 81. The upper mount 92 is rotatably connected to the connector 921. A lower mount 94 of the trim-tilt mechanism 9*a* is coupled to the couplers 84. Specifically, the lower mount 94 is connected to a connector 941 coupled to the couplers 84. The lower mount 94 is rotatably connected to the connector 941.

Figure 8:
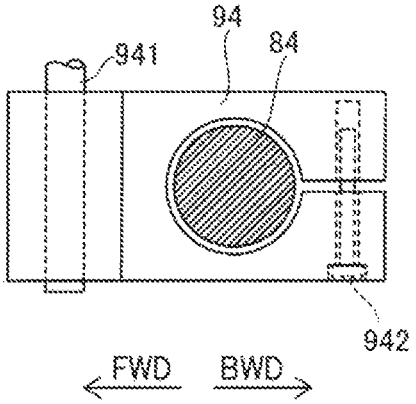
FIG. 8 is a plan view showing a lower mount of a trim-tilt mechanism of the outboard motor according to the second preferred embodiment of the present invention.

The trim-tilt mechanism 9*a* is connected to the couplers 84 of the support member 8*a* such that its coupling position with respect to the couplers 84 is adjustable. Specifically, the lower mount 94 of the trim-tilt mechanism 9*a* is fixed such that its coupling position is adjustable in a vertical direction with respect to the couplers 84. As shown in FIG. 8, the lower mount 94 is fastened with, for example, threaded fasteners 942 and is fixed to the couplers 84. In other words, the fastener members 942 are loosened such that the lower mount 94 is slidable with respect to the couplers 84.

The remaining structure of the second preferred embodiment is preferably similar to that of the above first preferred embodiment.

According to the second preferred embodiment of the present invention, the following advantageous effects are obtained.

According to the second preferred embodiment of the present invention, the support member 8*a* that steerably supports the outboard motor body 100*a* includes the upper support 82 that surrounds the drive shaft 21 and supports the outboard motor body 100*a*, the lower support 85 that is spaced below the upper support 82, surrounds the drive shaft 21, and supports the outboard motor body 100*a*, and the couplers 84 that couple the upper support 82 to the lower support 85, similarly to the first preferred embodiment. Thus, an increase in the entire length of a boat 10 including the outboard motor 200 is significantly reduced or prevented, and an increase in the size of the boat body 11 is significantly reduced or prevented.

According to the second preferred embodiment of the present invention, the outboard motor 200 includes the trim-tilt mechanism 9*a* that couples the couplers 84 of the support member 8*a* to the clamp brackets 81 and rotates the outboard motor body 100*a* in the vertical direction. Thus, the coupling position of the trim-tilt mechanism 9*a* with respect to the boat body 11 is elevated, and hence the drive amount of the trim-tilt mechanism 9*a* (the amount of extension of a cylinder 91) is reduced when the outboard motor 200 is fully tilted up. Furthermore, when the outboard motor 200 is fully tilted up, the coupling position where the trim-tilt mechanism 9*a* is attached to the boat body 11 is prevented from being under water.

According to the second preferred embodiment of the present invention, the coupling position of the trim-tilt mechanism 9*a* with respect to the couplers 84 of the support member 8*a* is adjustable. Thus, the coupling position of the trim-tilt mechanism 9*a* is adjusted according to the size of the boat body 11 and the size of the outboard motor 200 such that the trim of the outboard motor 200 is properly adjusted, and the outboard motor 200 is properly tilted up.

The remaining advantageous effects of the second preferred embodiment are similar to those of the above first preferred embodiment.

The preferred embodiments of the present invention described above are illustrative in all points and not restrictive. The extent of the present invention is not defined by the above description of the preferred embodiments but by the scope of claims, and all modifications within the meaning and range equivalent to the scope of claims are further included.

For example, while a single outboard motor is preferably provided in the boat in each of the first and second preferred embodiments described above, the present invention is not restricted to this. According to a preferred embodiment of the present invention, multiple outboard motors may alternatively be provided in the boat.

While the steering axis preferably overlaps with the drive shaft as viewed in the axial direction of the drive shaft in each of the first and second preferred embodiments described above, the present invention is not restricted to this. The steering axis may not overlap with the drive shaft as viewed in the axial direction of the drive shaft. For example, the steering axis and the drive shaft may be close to each other inside the support.

While the pair of couplers is preferably provided in each of the first and second preferred embodiments described above, the present invention is not restricted to this. According to a preferred embodiment of the present invention, one coupler may alternatively be provided, or three or more couplers may alternatively be provided.

While the couplers are preferably made of a material containing carbon fiber in each of the first and second preferred embodiments described above, the present invention is not restricted to this. According to a preferred embodiment of the present invention, the couplers may alternatively be made of metal. For example, the couplers may be made of a material containing metal such as aluminum or iron.

While the collar is preferably provided inside the damper in each of the first and second preferred embodiments described above, the present invention is not restricted to this. According to a preferred embodiment of the present invention, the collar may alternatively be provided outside the damper. Furthermore, the damper and the collar may alternatively be integral and unitary with each other.

While the shift shaft is preferably located in the through-hole of the housing in each of the first and second preferred embodiments described above, the present invention is not restricted to this. According to a preferred embodiment of the present invention, the shift shaft may alternatively be located outside the through-hole of the housing. For example, the shift shaft may be located outside the cover.

While the apron is preferably used as the cover or the first cover in each of the first and second preferred embodiments described above, the present invention is not restricted to this. According to a preferred embodiment of the present invention, the cover or the first cover may alternatively be a cover other than the apron. For example, the cover or the first cover may be a housing that covers the drive shaft.

While the upper cover is preferably used as the cover or the second cover in each of the first and second preferred embodiments described above, the present invention is not restricted to this. According to a preferred embodiment of the present invention, the cover or the second cover may alternatively be a cover other than the upper cover. For example, the cover or the second cover may be a housing that covers the drive shaft.

While the trim-tilt mechanism preferably couples the boat body to the outboard motor body in a state where the couplers of the boat body are above and the coupler(s) of the outboard motor body is below in each of the first and second preferred embodiments described above, the present invention is not restricted to this. According to a preferred embodiment of the present invention, the trim-tilt mechanism may alternatively couple the boat body to the outboard motor body in a state where the couplers of the boat body are below and the coupler(s) of the outboard motor body is above.

While the trim-tilt mechanism is preferably hydraulically driven in each of the first and second preferred embodiments described above, the present invention is not restricted to this. According to a preferred embodiment of the present invention, the trim-tilt mechanism may alternatively be driven other than hydraulically. The trim-tilt mechanism may be electrically driven, for example.

While the preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an outboard motor body including an engine and a drive shaft that is coupled to the engine and transmits power;

a mount to be mounted on a boat body; and a support that supports the outboard motor body so as to be steerable with respect to the mount; wherein the support includes an upper support that surrounds the drive shaft and supports the outboard motor body, a lower support that is spaced below the upper support, surrounds the drive shaft, and supports the outboard motor body, and a pair of couplers that couple the upper support to the lower support and are spaced apart at a predetermined interval in a right to left direction of the outboard motor; and the upper support and the lower support do not rotate with the outboard motor body about a steering axis.

2. The outboard motor according to claim 1, wherein the outboard motor body includes a cover that covers the drive shaft; and the pair of couplers couple the upper support to the lower support at a location outside of the cover.

3. The outboard motor according to claim 1, wherein the support supports the outboard motor body at a position forward of an exhaust passage through which exhaust air from the engine flows.

4. The outboard motor according to claim 1, wherein the outboard motor body includes a cover that covers the drive shaft and a housing including a through-hole in which the drive shaft is located; and the support surrounds the through-hole and supports the housing.

5. The outboard motor according to claim 4, further comprising a shift shaft in the through-hole of the housing.

6. The outboard motor according to claim 4, wherein the housing includes a flow passage through which at least one of exhaust air from the engine, engine oil, and cooling water flows.

7. The outboard motor according to claim 1, wherein the outboard motor body includes a cover that covers the drive shaft; and the support includes a support structure that supports the outboard motor body and is located inside the cover.

8. The outboard motor according to claim 7, wherein the cover includes a first cover and a second cover below the first cover;

the upper support includes an upper support that supports the outboard motor body and is located inside the first cover; and the lower support includes a lower support that supports the outboard motor body and is located inside the second cover.

9. The outboard motor according to claim 1, further comprising a damper between the support and the outboard motor body, and the support supports the outboard motor body through the damper.

10. The outboard motor according to claim 9, wherein the damper is annular, and has an inner diameter larger than a diameter of the drive shaft and an outer diameter smaller than or equal to an inner diameter of a support hole that supports the outboard motor body.

11. The outboard motor according to claim 10, wherein the outboard motor body includes a housing including a boss that protrudes in an axial direction of the drive shaft; and the support supports the outboard motor body by the boss being inserted into the support hole through the damper.

12. The outboard motor according to claim 11, wherein the support supports the outboard motor body by the boss being located in the support hole through an annular collar to allow rotation of the outboard motor body and the damper.

13. The outboard motor according to claim 1, wherein the support rotatably supports the outboard motor body about the steering axis; and the steering axis overlaps with the drive shaft as viewed in an axial direction of the drive shaft.

14. The outboard motor according to claim 1, further comprising a trim-tilt mechanism that couples the lower support to the mount and rotates the outboard motor body in a vertical direction.

15. The outboard motor according to claim 1, further comprising a trim-tilt mechanism that couples the pair of couplers to the mount and rotates the outboard motor body in a vertical direction.

16. The outboard motor according to claim 15, wherein a coupling position of the trim-tilt mechanism with respect to the pair of couplers is adjustable.

* * * * *